United States Patent [19]

Fisher

[11] Patent Number: 4,680,006

[45] Date of Patent: Jul. 14, 1987

[54] BLOWER AUGMENTOR FOR POWER OIL AND POWER GAS BURNERS

[75] Inventor: Leonard A. Fisher, Granby, Conn.

[73] Assignee: The Carlin Company, Windsor, Conn.

[21] Appl. No.: 734,837

[22] Filed: May 16, 1985

[51] Int. Cl.[4] ..... F23Q 3/00

[52] U.S. Cl. ..... 431/265; 415/182; 415/119

[58] Field of Search ..... 432/222; 126/110 R, 126/110 A; 431/265; 415/119, 216, 217, 182, 219 C

[56] References Cited

U.S. PATENT DOCUMENTS

| | | | |
|---|---|---|---|
| 960,815 | 6/1910 | Carlisle | 126/110 A |
| 1,855,339 | 4/1932 | Cornelius | 431/265 |
| 1,945,223 | 1/1934 | Jaden | 126/110 A |
| 2,287,822 | 6/1942 | Odor et al. | 415/208 |
| 2,637,375 | 5/1953 | Tapp et al. | 431/265 |
| 2,744,568 | 5/1956 | Johnson | 431/265 |
| 3,367,570 | 2/1968 | Reichmann | 432/222 |
| 3,480,202 | 11/1969 | Stephenson, Jr. | 415/208 |
| 3,775,029 | 11/1973 | Rant | 415/219 C |
| 4,388,064 | 6/1983 | Kaplan et al. | 431/89 |
| 4,573,869 | 3/1986 | Kitamoto | 415/182 |

FOREIGN PATENT DOCUMENTS

| | | | |
|---|---|---|---|
| 920940 | 2/1973 | Canada | 431/265 |
| 0101247 | 6/1982 | Japan | 126/110 A |
| 477296 | 12/1937 | United Kingdom | 431/265 |
| 1203408 | 8/1970 | United Kingdom | 431/354 |

*Primary Examiner*—Samuel Scott
*Assistant Examiner*—H. A. Oclar
*Attorney, Agent, or Firm*—H. Gibner Lehmann; K. Gibner Lehmann

[57] ABSTRACT

A power oil or gas burner having a centrifugal blower that includes a standardized production scroll housing. Within the space available in the scroll housing a narrow-width, large (maximum) diameter squirrel cage rotor is provided, that is offset away from the air inlet ring of the blower. In combination with a scroll extension carried by the housing and disposed adjacent the rotor, the invention provides a unique barrier wall member that is mounted in the housing and extends within the squirrel cage rotor, such barrier member providing for a more stable flow of air at higher static pressures and higher capacity that was previously attainable, and reducing whine and whistle from the blower operation.

7 Claims, 12 Drawing Figures

S.P. INS. W.C.
GPH OIL
CFM AIR

UNSTABLE FLOW
STABLE FLOW
WIDE OPEN FLOW
CFM
S.P.

50
74
76
52
80

50
76
80
52

52
50
76
80
74
50

74
78
76
80

STABLE FLOW
UNSTABLE FLOW
C'
3.5
2.0
RECIRC. AIR
116
106
112
114
110
0 1 2 3 4 5 6 GPH OIL
0 30 60 90 120 150 180 CFM AIR 76
80
74
78

BLOWER AUGMENTOR FOR POWER OIL AND POWER GAS BURNERS

BACKGROUND

This invention relates to power oil and gas burners of the type employing centrifugal blowers, and more particularly to air flow control devices for use with blower squirrel cages to improve the air outputs of the blowers.

Over the past two decades there has been a strong movement in connection with oil and gas fired boilers and furnaces, toward higher efficiencies, particularly higher annual efficiencies. Consequently the boiler or furnace units have become more compact and their heat exchangers now are more airtight and more resistant to the flow of flue gasses through them.

Such boiler and furnace developments have put a much greater demand on this type of power oil or gas burner to provide improved blower pressures and stability so that the flame would not pulsate upon ignition or shutdown.

Heretofore when using a wide, close-fitting blower wheel or rotor in a power oil or gas burner housing the air delivery was not sufficiently uniform to give reliable, pulsation-free stable combustion with many of the latest boilers or furnaces. As at present understood, the reason was that the blades of the rotors operated at or near their "stall" speed or condition, functioning much like the air foil structure of an airplane wing when the air speed is too low.

It was found that, by using a narrower wheel or rotor (typically about $\frac{2}{3}$ as wide as the housing space) and by locating it away from the air inlet side or ring of the housing, the rotor blades never handled volumes of air that were low enough to cause a stall condition. This is because, even at a no-flow condition of the burner, the rotor is recirculating enough air to prevent air stall.

Even so, such prior arrangments did not fully approach the maximum high pressures that could be obtained, because much of the kinetic energy imparted to the air was dissipated in the recirculation process. By using a larger diameter rotor than that intended for the original housing design, the pressures obtained had been increased slightly but then the resultant whistle (siren effect) became intolerable. It was found that by adding a scroll extension which had a short straight portion, such whistle could be reduced, and that by adding a side baffle to the scroll the pressure could be increased by about 30% over previous standard designs.

However, these prior improvements all left something to be desired because burner performance was still thought to be not maximized, considering the power available, the energy imparted to the rotor and the noise levels determined to be tolerable or acceptable. It was believed that the problem of inefficient air flow still existed, as well as that of noise reduction.

SUMMARY

The above disadvantages and drawbacks of prior blower housings and rotors for burners, and of blowers having offset space areas filled by an added baffle member, are overcome by the present invention which has for one object the provision of a novel and improved air flow control device which is especially effective in improving the stability of the air flow from a given motor, rotor and scroll housing combination, all with a minimum increase in noise level.

An additional object of the invention is to provide an improved air-flow control device as above set forth, which will provide a very appreciable increase of static air pressure, as for example on the order of plus 75%, and an appreciable increase of capacity, as for example on the order of plus 20%.

Another object of the invention is to provide an improved air flow control device in accordance with the foregoing, which is in the form of a simple barrier wall that is enclosed by the squirrel cage rotor of the oil-burner blower and that directs the air flow therein in such a manner as to provide greatly improved performance of the blower.

Still another object of the invention is to provide an improved air control device as above set forth, which is especially simple in its construction, being economical to fabricate and incorporate in various blowers.

A further object of the invention is to provide an improved air control device of the kind indicated, which is reliable and foolprooof in its operation and not likely to malfunction even after an extended period of use.

Still another object of the invention is to provide an improved air control device as above characterized, which is adaptable for installation in different sizes and types of oil burners, with but little modification or added cost.

A feature of the invention resides in the provision of an improved air flow control as outlined above, which is in the form of a simple, sheet-metal add-on or attachment that requires no appreciable modification or alteration of existing blower structures.

Other features and advantages will hereinafter appear

In accomplishing the above objects the invention provides, in an oil burner, a blower having a standardized cast metal scroll housing and a driven, bladed squirrel cage impeller or rotor therein, said housing having a tangential air outlet and a spiral wall encircling the squirrel cage. Mounted in the housing is a stationary barrier wall extending into the interior of the squirrel cage. The barrier wall extends radially outward from a central point of the squirrel cage to a location adjacent the blades of the latter.

The barrier wall is preferably disposed in a substantially radial plane with respect to the spiral wall, and has an outer edge portion which, with an extension of the scroll wall of the housing, forms a traversal space through which the blades of the squirrel cage travel. The extension of the scroll wall comprises a separate piece attached to said wall, such piece carrying a flat, plate-like support member that mounts the barrier wall.

The scroll housing is wider than the squirrel cage in axial dimension, and the latter is offset toward the motor side; the resultant space existing between these parts accommodates a flat, plate-like support member for the barrier wall. Preferably the barrier wall and the plate member are integral with each other, being constituted from a single piece.

The cast metal scroll housing has in a side wall, an air inlet opening or ring which is spaced a substantial distance axially from the end wall of the squirrel cage, and such axial space is preferably spanned by the said barrier wall. Increases in static pressure in the neighborhood of 75%, and in capacity in the neighborhood of 20% can be expected, by the practise of the invention.

Still other features and advantages will hereinafter appear.

In the drawings which illustrate one embodiment of the invention, that at present preferred:

Figures 1, 2, 8, 9, 10, 11:
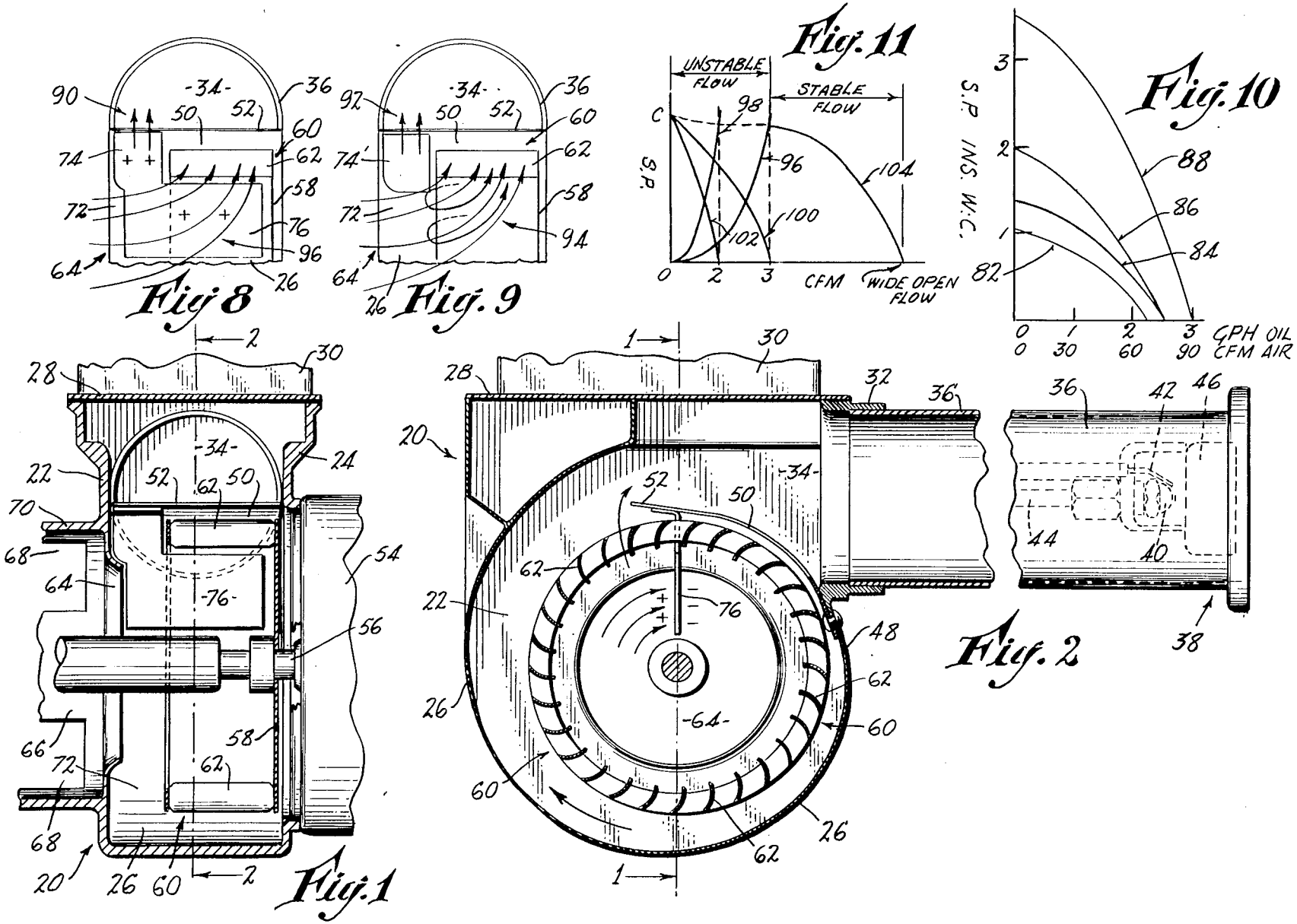
FIG. 1 is a vertical axial sectional view through the squirrel cage portion of an oil burner blower of the type under consideration.
FIG. 2 is a vertical section taken on the line 2—2 of Fig. 1.
FIG. 8 is a diagrammatic showing of the barrier wall in elevation, and the squirrel cage in vertical section, disposed in the blower housing.
FIG. 9 is a view like that of FIG. 8 but with the barrier wall deleted.
FIG. 10 is a chart showing the performance curves of comparative blower constructions.
FIG. 11 is a chart showing curves typical of earlier, prior burners.

Referring first to FIGS. 1 and 2 there is illustrated a cast metal blower housing 20 having side walls 22 and 24 and a spiral scroll wall 26. The housing 20 has a flat top wall 28 on which there is suppported an ignition transformer 30. Connected to the top wall 28, side walls 22 and 24, and scroll wall 26 is an outlet fitting 32 which together with said walls constitutes a tangential air outlet passage 34.

The outlet fitting 32 telescopically receives and supports an air tube 36 having a burner head designated generally by the numeral 38 and comprising a nozzle 40, ignition electrodes 42, fuel pipe 44 and flame retention head 46.

The beginning end portion of the spiral scroll wall 26 is designated 48 and has attached to it a separate wall piece 50 which forms an extension of the scroll and blocks a portion of the tangential air outlet 34 as clearly seen in FIG. 1, such separate piece having a flat free end portion 52.

Mounted on the side wall 24 of the housing 20 is the blower motor 54 having a drive shaft 56 carrying the end wall 58 of a rotary squirrel cage air impeller 60 comprising blades 62 disposed in a circle around the shaft 56, said squirrel cage impelling air outwardly from a central area surrounding the drive shaft 56. The term "squirrel cage" is well known in the air blower or impeller art; in general it refers to a rotary cage-like structure having a large number of parallel, slanted blades which extend in axial directions and which are circumferentially disposed about an axis of turning, being spaced therefrom and usually parallel thereto. The end wall 58 of the squirrel cage 60 is closely adjacent the motor 54, being offset toward the housing wall 24 as seen in FIG. 1. The housing wall 22 has an air inlet 64 communicating with the air cage 66 which has openings 68 in its circular outer wall 70.

From FIG. 1 it will be noted that the offset of the squirrel cage 60 is to the right, providing excess space 72 surrounding the air intake 64, this being due to the squirrel cage having a narrower dimension and greater radius. This figure also shows that the scroll extension 50 spans a portion of the tangential air outlet passage 34.

In prior blowers of the above construction a filler piece 74, see FIG. 9, has been used to occupy the space area 72 in order to improve the performance of the blower, but the results have not been especially noteworthy even though some improvement was noted.

In accordance with the present invention a unique barrier wall 76 is provided, disposed within the squirrel cage 60 and preferably attached to and supported by the filler piece 74, such wall spanning space between the air inlet or opening 64 and the end wall 58 of the squirrel cage, as shown in FIG. 1. The barrier wall 76 extends outward from a central axial area of the squirrel cage 60, to a location adjacent the squirrel cage blades 62; it is preferably constituted of sheet metal and formed integral with the filler piece 74, both being fabricated from a single sheet metal blank 78 which also has a mounting flange portion 80 as seen in FIGS. 3 through 7. Between the wall piece 50 and the radially outer edge of the barrier wall 76 a traversal space exists, through which the blades 62 of the squirrel cage rotor 60 can pass as the rotor turns.

Figures 3, 4, 5, 6, 7, 12:
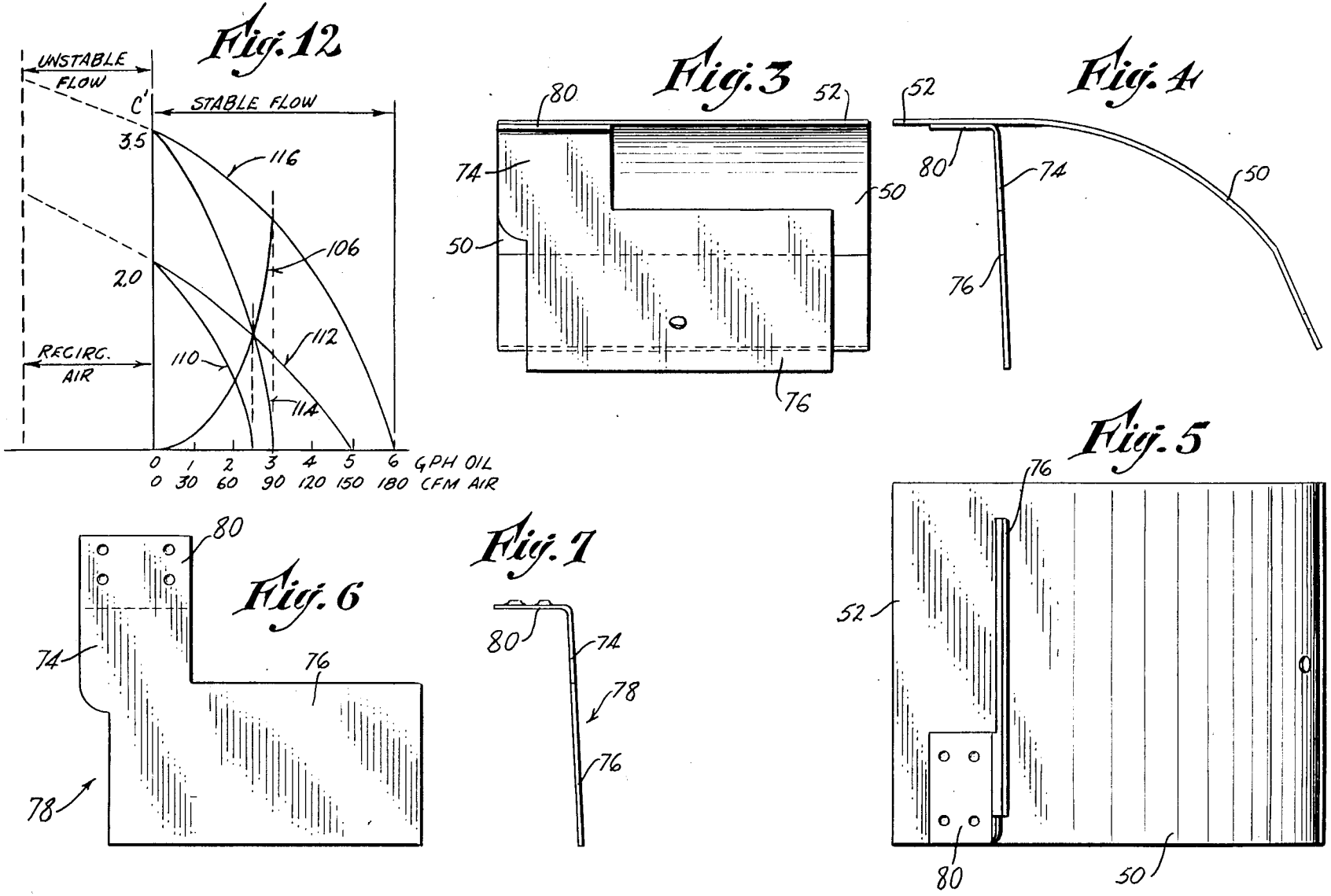
FIG. 3 is a rear elevational view of the barrier wall and scroll wall extension assemblage.
FIG. 4 is an edge elevation of the assemblage of FIG. 3.
FIG. 5 is a bottom plan view of the assemblage of FIGS. 3 and 4.
FIG. 6 is a plan view of the barrier wall prior to bending a flange portion thereof.
FIG. 7 is an edge view of the barrier wall after the bending of the support flange portion thereof.
FIG. 12 is a chart showing the improved results obtained by utilizing the burner improvement of the present invention.

I have found that by the provision of the barrier wall 76 a marked improvement is had in the performance of the blower, as indicated by the curves depicted in FIGS. 10 and 12. In FIG. 10 the vertical scale indicates static pressure in inches water column, and the horizontal scale indicates capacity of the burner in gallons per hour of oil and cubic feet per minute (cfm) of air. The curves designated 82 and 84 were made with blower structures where no scroll extension such as the piece 50 was employed, and with the squirrel cage having a width commensurate with the inside width of the housing 20, and smaller diameters. The curve 86 was made with a narrower squirrel cage and larger diameter, and utilizing a scroll extension piece 50 and filler piece 74, as those shown in FIG. 9. The curve 88 was made with the same structures as shown in FIG. 9 but with the addition of the barrier wall 76 as indicated in FIG. 8. It will be seen that the curve 88 gives the best static pressure, with the curve 86 coming in second best.

As at present understood, the improved performance of the blower is due to the barrier action of the barrier wall 76 on the air currents circulating within the squirrel cage 60. This can be understood by referring to the showing of FIGS. 8 and 9. In FIG. 9 the barrier wall 76 is absent, and the arrows indicated at 94 show that not only is the squirrel cage 60 throwing out a considerable amount of air that is coming into the blower through the inlet 64, but also that recirculating air from the scroll space itself is being sucked into the interior of the squirrel cage and being thrown out, as well. However, when the barrier wall 76 is utilized, the amount of recirculating air is reduced because some of it is being blocked by the wall.

The curve 86 in FIG. 10 illustrates the net result obtained from the set-up in FIG. 9, whereas the curve 88 of FIG. 10 shows the net result obtained from the set-up in FIG. 8.

The arrows 90 and 92 in FIGS. 8 and 9 show the effect of the baffle and mounting plates or pieces 74, 74'. In each instance, not much change is noticed in the air which is redirected by the mounting pieces 74 or 74' regardless of the absence or presence of the barrier wall 76, since the air stream that is blocked by the mounting pieces passes upward and out through the outlet 34.

Thus it is established that the mounting piece 74 has an important supplementary action in the prevention of recirculating air (see arrows in FIG. 9) from occurring (see FIG. 10) within the housing 20 (refer also to FIG. 12, dotted portion at the left of the vertical "O" reference line).

FIG. 11 illustrates the action of earlier, prior burners of the type having wide rotors which closely fit the scroll housing. Note that the broken-line area of the graph is at unstable flows, where the blades are in a stalled condition. The vertical scale is static pressure, and the horizontal scale is in cubic feet per minute of flow. The curve 96 (Rmin) represents the resistance of the combined burner head (full forward) with the air band/air shutter (openings 68) wide open. The curve 98 (Rmax) represents the resistance of the combined burner head (closed or zero setting) and the air band/air shutter openings 68 nearly closed.

The curve 104 represents the unrestricted condition of wide open flow (no combined heads). The curve 100 (C-1) is the maximum burner capacity and represents the difference between the unrestricted curve 104 and the Rmin curve 96. The curve 102 is the minimum burner capacity and represents the difference between the unrestricted curve 104 and the Rmax curve 98.

FIG. 12 illustrates how the barrier member 76 eliminates the unstable or recirculating air part of the curves, shown in the broken lines. The higher curves represent the advantage of the use of the barrier member. The entire range in solid lines is stable, and the higher static pressure together with stable flow over unstalled blades make the blower more immune to pulsations.

The curve 106 (Rmin) is for minimum resistance to flow. It is a parabolic function, constituting one half of a parabola. Curves 110 and 112 are without the barrier member 76, and curves 114 and 116 are with the barrier member. Curves 112 and 116 are with an unrestricted air tube and a wide open air inlet.

Each and every one of the appended claims should be considered on its own merits as regards the prior art, and variations and modifications of the invention are possible within the scope of the claims.

I claim:

1. In an oil burner, in combination:

(a) a blower comprising a scroll housing and a driven squirrel cage therein, said squirrel cage having an interior air space, and having blades disposed around said interior air space and constituting an air impeller, (b) said scroll housing having a tangential air outlet, and further comprising a spiral wall encircling said squirrel cage, (c) a stationary barrier wall mounted in the housing and extending into the said interior air space of the squirrel cage, said barrier wall extending outward from and with respect to a central axial area of the squirrel cage to a location adjacent the said blades thereof, (d) said housing being wider than the squirrel cage in axial dimension, thereby to provide an end space between the squirrel cage and the housing, in which end space air tends to recirculate in the housing, and (e) support and baffle means disposed in the said end space between the housing and squirrel cage, for mounting said barrier wall and for redirecting in outward directions a portion of the circularly travelling recirculating air in the housing.

2. An oil burner as set forth in claim 1, wherein:

(a) said support and baffle means is disposed in a substantially radial plane with respect to said spiral wall.

3. An oil burner as set forth in claim 1, and further including:

(a) a separate wall piece carried by the housing and blocking a portion of the tangential air outlet thereof, (b) said support and baffle means joining the said separate wall piece to the said barrier wall for supporting the barrier wall in its operative position.

4. An oil burner as set forth in claim 1, wherein:

(a) said housing has an air inlet, said inlet having an edge, (b) said support and baffle means extending radially outward beyond the edge of the housing air inlet.

5. An oil burner as set forth in claim 2, wherein:

(a) said support and baffle means comprises a plate member disposed in the same plane as the said barrier wall.

6. An oil burner as set forth in claim 5, wherein:

(a) said plate member and barrier wall are integral with each other and formed from a single piece of sheet metal stock.

7. An oil burner as set forth in claim 3, wherein:

(a) said support and baffle means has an integral flange by which it is attached to the said separate wall piece.

* * * * *